US005158302A

United States Patent [19]

Rewega

[11] Patent Number: 5,158,302

[45] Date of Patent: Oct. 27, 1992

[54] THREE-PLAYER CHESS GAME

[76] Inventor: Dana R. Rewega, 201 - 146 E. 18th Street, North Vancouver, British Columbia, Canada, V7L 2X5

[21] Appl. No.: 764,516

[22] Filed: Sep. 20, 1991

[51] Int. Cl.[5] ..... A63F 3/02

[52] U.S. Cl. ..... 273/261; D21/24

[58] Field of Search ..... 273/261, 260; D21/24

[56] References Cited

U.S. PATENT DOCUMENTS

| | | | |
|---|---|---|---|
| 259,695 | 6/1882 | Kingwell | 273/261 |
| 3,533,627 | 10/1970 | Deffenbaugh et al. | 273/261 |
| 3,744,797 | 7/1973 | Hopkins | 273/261 |
| 3,778,065 | 12/1973 | Hale | 273/261 |
| 3,836,149 | 9/1974 | Adams et al. | 273/261 |
| 3,964,747 | 6/1976 | Balmforth | 273/261 |
| 4,580,787 | 4/1986 | Baker | 273/261 |

FOREIGN PATENT DOCUMENTS

| | | | |
|---|---|---|---|
| 2225729 | 6/1990 | United Kingdom | 273/261 |

OTHER PUBLICATIONS

"Rules of the Game of Hex" by Andrew S. Braden, pp. 20–21, 1970.

*Primary Examiner*—Benjamin H. Layno
*Attorney, Agent, or Firm*—Bull, Housser & Tupper

[57] ABSTRACT

A chess game for three players including a game board of generally truncated triangular shape with 4 spaces at the apex and 8 or 9 spaces along each side. Hexagonal shaped spaces of three alternating colors are located uniformly on the surface of the board. The game includes 3 sets of chest pieces with 6 pawns, 3 bishops, 2 knights, 2 rooks and queen and a king in each set. On opening, each set of playing pieces is located in the first 3 rows of the apexes on the board.

16 Claims, 8 Drawing Sheets

THREE-PLAYER CHESS GAME

BACKGROUND OF THE INVENTION

1. Field of the Invention

This invention relates to a novel three-player chess game and more particularly relates to a three-player chess game in which each set of chess pieces is initially positioned adjacent a relatively narrow apex on a game board having hexagonal spaces arranged in a truncated triangular shape.

2. Description of the Prior Art

Modified chess games designed for play by three players are known. See for example Adams et al (U.S. Pat. No. 3,836,149) in which a three-player chess game apparatus is disclosed. The game is played on a board with hexagonal shaped spaces with a periphery of spaces forming a generally truncated triangle with an additional two spaces extending outwardly at each apex portion of the triangle. The initial position of the game pieces is adjacent the apex portions. One difficulty with the Adams' chess game is the use of the additional set of spaces in the first row or rank of each apex portion which extends outwardly beyond the ends of the adjacent ranks. These extended spaces are relatively sheltered and provide additional protection for any pieces located on these spaces. This modification introduces variations of play not found in the conventional chess game, as pieces located on these sheltered spaces are protected to a greater degree than on other spaces of the board, and it employs a more complex overall shape to the board and set-up. Furthermore, all the six pieces located in the first rank must wait for the second rank to open up before pieces in the first rank may be moved. In particular, Adams positions the bishops three ranks back from an open space making it more difficult to move the bishops out into play. The positioning of the bishops in the outside protected spaces of the first rank also makes it more difficult to move these pieces out taking away from the "feel" of a conventional two person chess game. The Adams piece layout also provides pawns in the second and third ranks making it quite difficult to determine which pawns have made their initial move and which have not, given that pawns may move initially either one space or two spaces forward. In addition, Adams provides only two bishops which leaves one set of indicia spaces in which no bishops of each set of playing pieces may protect or attack.

Other versions of three-player chess are Hale (U.S. Pat. No. 3,778,065) and Baker (U.S. Pat. No. 4,580,787). Both patents provide for two rows of playing pieces in the initial setup which might, at first glance, appear to more closely approximate a conventional game where the initial position of pieces is in two ranks with pawns in the second rank and major pieces in the first. However, on closer examination it becomes apparent that, unlike a conventional two-player chess game, each of the major pieces is open to immediate attack by an opponent's pieces along the same coloured rows. In order to prevent this occurrence both games disclose a rule referred to as a "block" which prevents movement between two pawns sitting on adjacent spaces. This rule has no equivalent in the conventional chess game. This rule adds an added non-conventional element to the game and also weakens the movement permitted by bishops and the queen. In order to accommodate two rows of pieces along sides of the board a larger board is employed which reduces the ratio between occupied and unoccupied spaces from that of a conventional chess game, on opening. This provides a much more open or spaced out game board which adversely affects the "feel" of the game as compared to a conventional chess game which provides a fifty percent ratio of occupied to unoccupied spaces at the beginning of the game. The Baker patent discloses a hexagonal periphery of spaces with each side comprised of nine spaces and the Hale patent discloses a board with six spaces along the apex and eight spaces along the sides of a truncated triangle periphery.

The Hopkins patent discloses a modified chess game for three players played on a board having hexagonal spaces with a truncated triangular shape having five spaces at each of the apexes and ten spaces along each side. Additional major pieces are provided with each set of pieces including only four pawns and fourteen major pieces as compared to eight pawns and eight major pieces in a conventional chess game. Major pieces are disposed in each of the three ranks of the opening position of each set of pieces. Even with the additional pieces, the larger playing board provides a ratio of occupied to unoccupied spaces which is much higher than in the conventional chess board.

All the modified chess games described above incorporate modifications which take away from the "feel" of a conventional chess game. While it is appreciated that modification from a two-player chess game to a three-player chess game will inherently have a different "feel" from the conventional game, there remains a need for a three-player chess game which more closely approximates the "feel" of a conventional chess game with necessary accommodation for three players. By more closely approximating the conventional game of chess, a more popular three-player chess game is developed as players will have a minimal level of adjustment in playing a three-player game. This will provide improved enjoyment of the three-player game with a minimum of adjustment by players used to the conventional two-player game.

SUMMARY OF THE INVENTION

The present invention provides a three-player chess game having a game board with hexagonal shaped spaces forming a truncated triangular periphery with four spaces at each apex. Each set of playing pieces occupies the first three ranks of spaces adjacent the apexes. This permits the positioning of the pieces such that the major pieces in the first rank are protected by the lessor major pieces in the second rank and the pawns in the third rank. Placement of knights in the second rank permits movement past the pawns in a manner similar to that of a conventional chess game. Having four spaces at the apex means that the second rank will have five spaces, two of which are for the knights and three of which are for the bishops enabling each bishop to occupy each of the three indicia on the board. Having four spaces in the first rank permits both the king and queen to be positioned in the first rank protected by the pieces in the second and third ranks. This also permits both rooks to be positioned on the first rank, which restricts initial movement of those rooks, much like restrictions on rooks of a conventional chess game which must wait for openings along the first rank or along its file before movement is permitted. This game board structure with a four space first rank, five space second rank and six space third rank permits orientation on opening of playing pieces as discussed above to provide a game which more accurately adopts the "feel" of a conventional game. Furthermore, such a game board with eight spaces on each side provides an occupied to unoccupied ratio of 45/87 or 51.72% at opening, closely approximating the 50/50 ratio of the conventional game. Alternatively, by providing sides of nine spaces an occupied to unoccupied ratio of 45/102 or 44.12% can be provided.

Accordingly, the present invention provides a game apparatus having a game board which includes a plurality of contiguous hexagonal playing spaces uniformly distributed on the board with the spaces forming a truncated triangular periphery having three longer sides and three shorter apexes. The first rank of each of the apexes is four spaces in length. Each of the spaces includes one of three indicia so that no two adjacent spaces have the same indicia. Three sets of playing pieces are provided, with each set including indicia which correspond to one of the three space indicia. Each of the playing pieces occupies the first three rows of spaces adjacent corresponding apexes.

Preferably the game board includes sides having eight spaces. Alternatively, the sides may have nine spaces. Chess playing pieces may be employed with one queen, one king and two rooks in the first rank, two knights and three bishops in the second rank and six pawns in the third rank. The three bishops may be on adjacent spaces, flanked on each side by a knight.

In one alternative, the queen may be to the left of the king and in another alternative the king may be to the left of the queen on adjacent spaces in the first rank, flanked by rooks at each end.

As a further alternative, the indicia may be colours with each indicia as a separately identifiable colour. The colours may be black, white and red.

DESCRIPTION OF THE PREFERRED EMBODIMENTS

Figure 1:
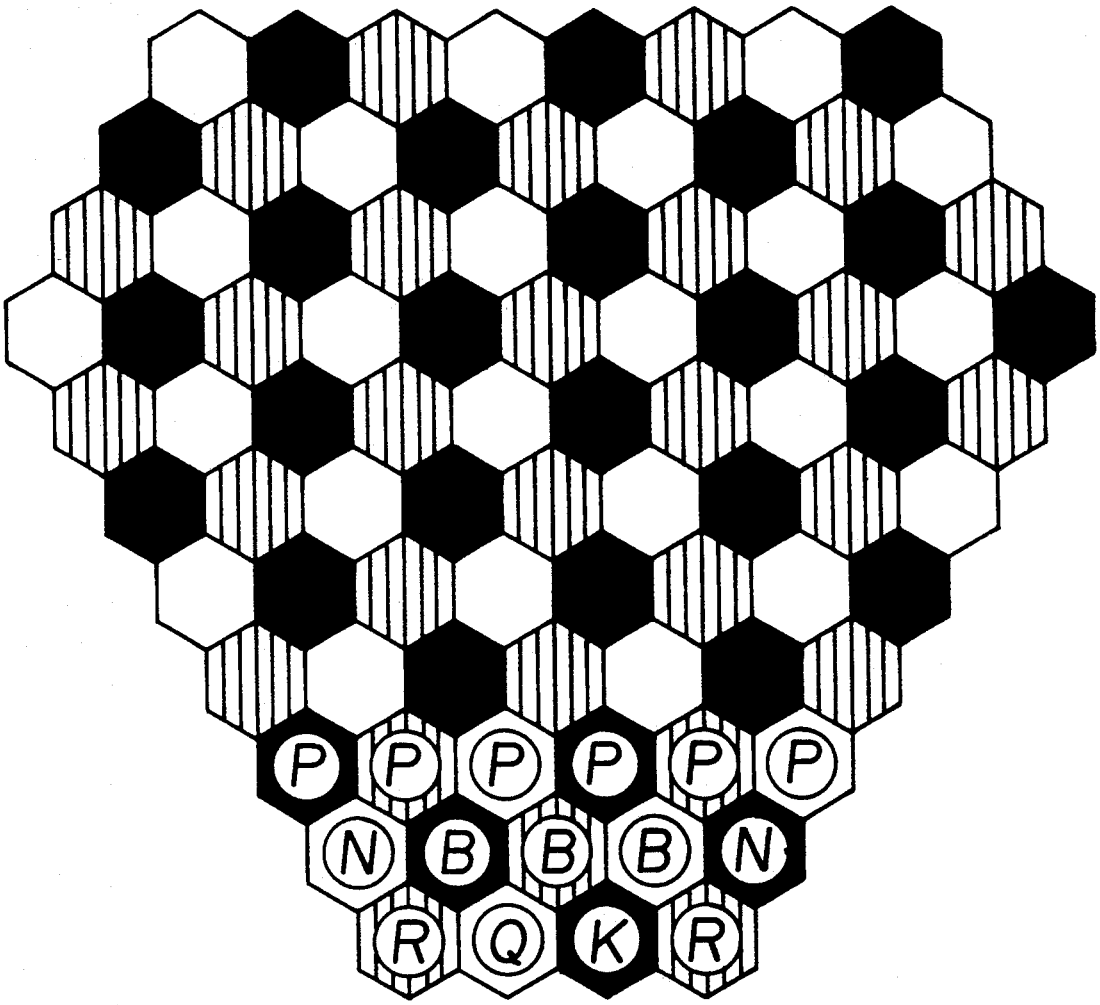
FIG. 1 is a plan view of the game board of the present invention showing the alignment of one player's game pieces in the opening position.

Referring to FIG. 1, game board 20 is depicted having a plurality of contiguous hexagonal playing spaces 22 uniformly distributed on board 20. Spaces 22 form a generally truncated triangular periphery with three apex portions 24 and three side portions 26.

Spaces 22 include one of three indicia, differentiated in FIG. 1 with white spaces 28 denoted in white with black outline, black spaces 30 denoted in black, and red space 32 denoted with black striping. Spaces 22 are oriented on the board so that no two adjacent spaces have the same indicia. It follows that each space has spaces of alternating indicia of different indicia from that space, about the circumference of that space.

Board 20 has 87 spaces. Apex 24 is four spaces wide and side 26 is eight spaces wide in the preferred embodiment of FIG. 1.

FIG. 1 also depicts the placement of one of the three players' playing pieces 34 oriented along the first three ranks of an apex portion 24. It should be understood that the positioning of the other player's pieces are identical in arrangement as depicted in FIG. 1, located at the other two apexes. They may be interchanged so long as the pieces of the same colour are positioned in the same apex portion 24, on opening.

Figure 2:
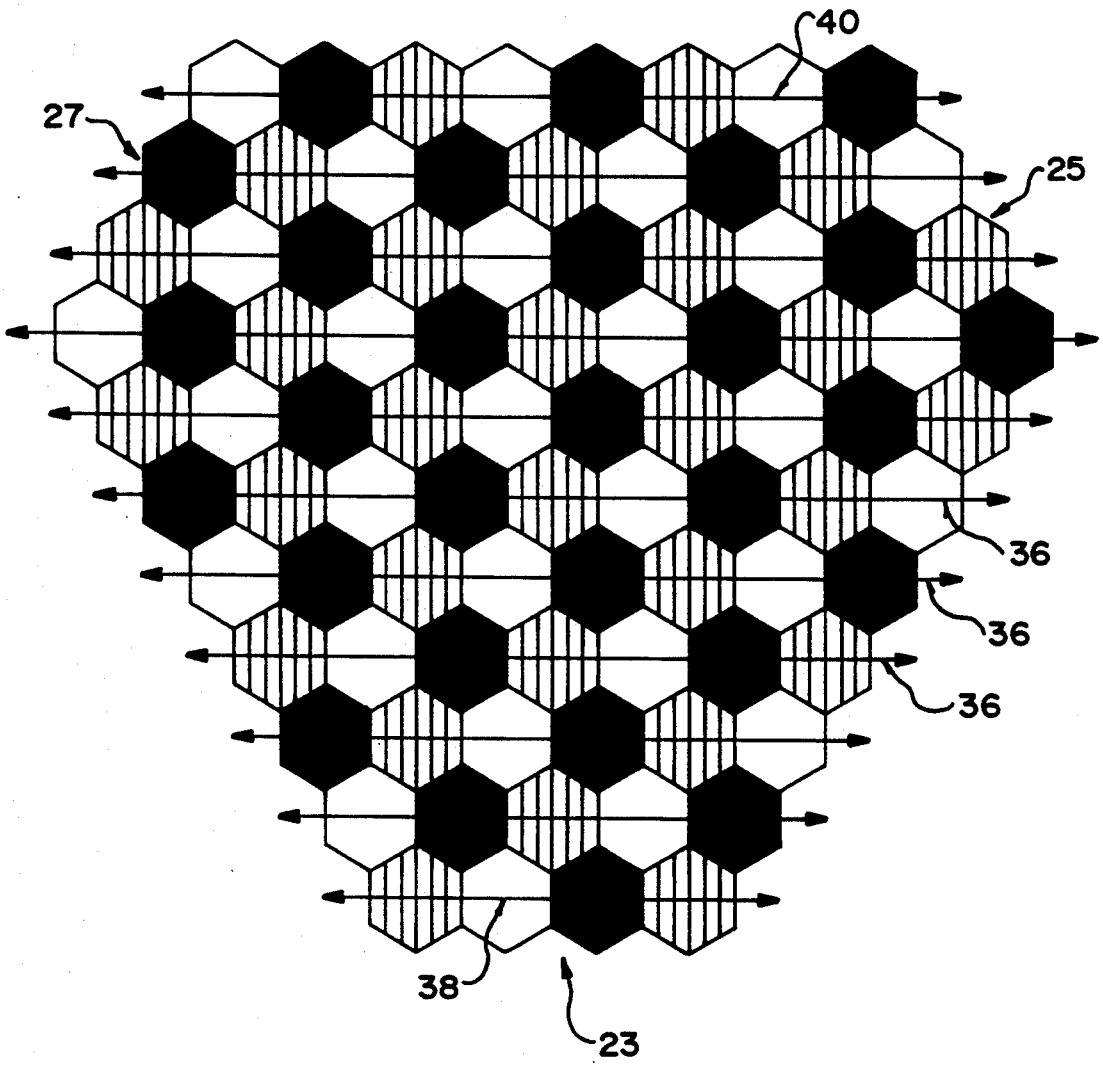
FIG. 2 is a plan view of the game board of FIG. 1 indicating the ranks of that player.

Referring to FIG. 2, there is shown one player's ranks depicted by arrows 36. It can be seen that the board game of the preferred embodiment incorporates eleven ranks which are numbered consecutively starting at the first rank depicted by arrow 38 and ending at the eleventh rank at arrow 40. The other two player's ranks would be similarly numbered from apex portion 25 and 27.

Figure 3:
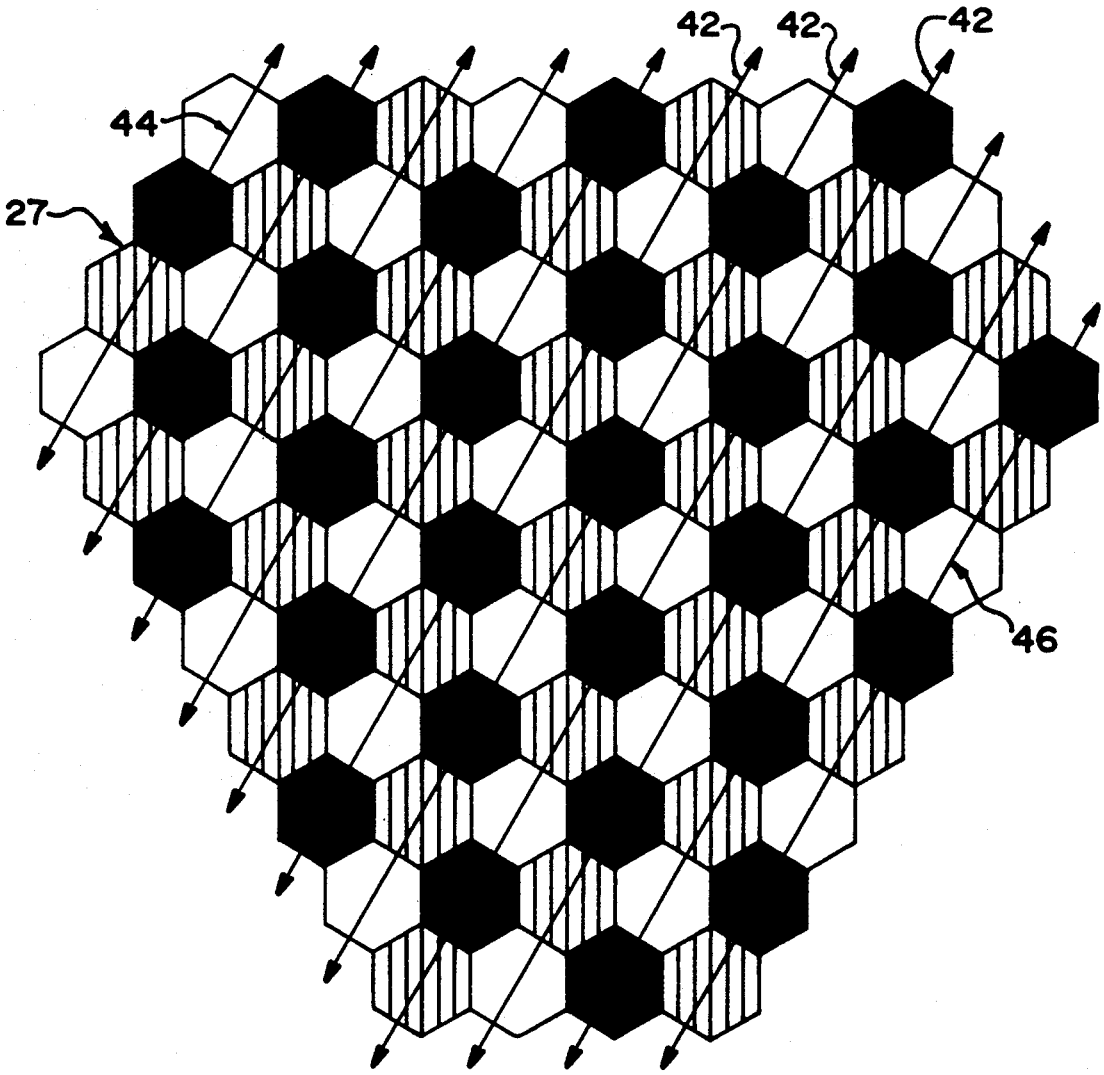
FIG. 3 is a plan view of the game board of FIG. 1 showing that player's right files.
Figure 4:
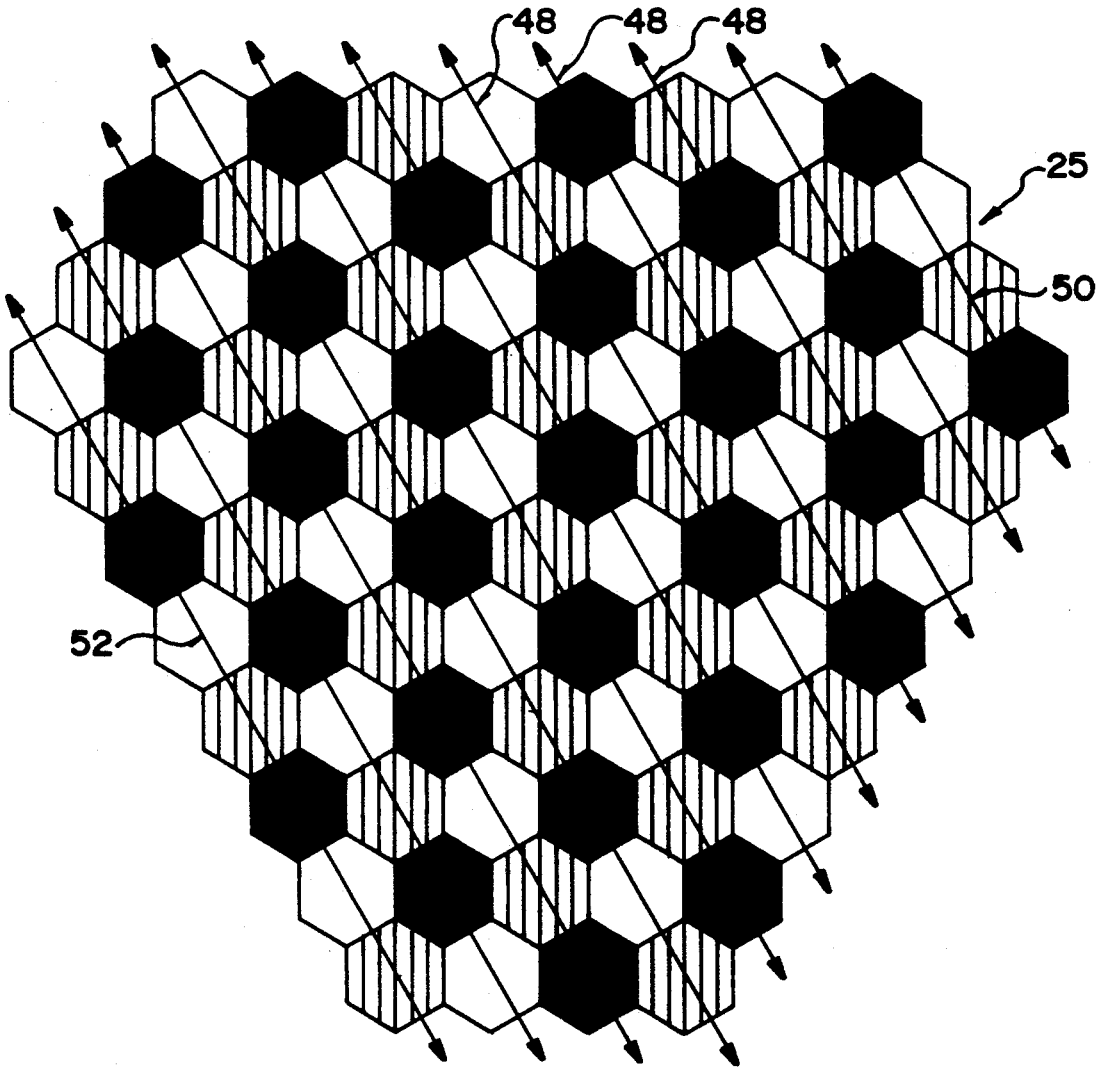
FIG. 4 is a plan view of the game board of FIG. 1 showing that player's left files.

Referring to FIG. 3 the same player's right files are depicted by arrows 42 extending diagonally generally from the left side of the board upwardly towards the top right side of the board, as depicted in FIG. 3. These right files can be similarly numbered starting from the far left file identified by arrow 44 through to the eleventh right file identified by arrow 46. Note that these numerical values correspond with the "rank" numbers of the second player. FIG. 4 depicts the same player's left files by arrows 48 with numbering convention beginning from apex 25 as number 1, depicted by arrow 50 to the eleventh left file depicted by arrow 52. Note that the numerical values correspond with the "rank" numbers of the third player. It can readily be seen that, unlike the conventional two-player chess game, each player's files are split into left diagonals and right diagonals (which are in effect made up of his two opponents' ranks) and are thus numbered correspondingly to accommodate the hexagonal-spaced, triangular-shaped game board of the present invention.

For ease of reference in naming particular positions on the board a general convention has been adopted in which white's rank and right file only are used in order to identify the position of a particular piece.

As with the conventional chess game, particular pieces are restricted in movement. Without regard to such restrictions, there are twelve directions of movement possible from the intermediate spaces of the board. That being along rows defined by and commencing with the adjacent spaces which are of a different colour than that space and the same coloured spaces surrounding but not touching that space wherein pieces are moved between immediately adjacent spaces along rows of the same colour. Movement along rows of spaces initiated with any next adjacent space to a particular space can be thought of as movement along the ranks and files as depicted by arrows 36 in FIG. 2, 42 in FIG. 3 and 48 in FIG. 4. This can generally be analogized to movement along the ranks and files of a conventional chess board in a straight forward direction or in a lateral direction along the board. As well, movement is permitted by some pieces along spaces of the same colour which can be analogized to a conventional chess game diagonal movement of certain pieces along squares of the same colour. For purposes of playing applicant's chess game, the spaces of the same colour, although not in physical contact, are considered as "adjacent" spaces. Note also that in a conventional chess board the particular files may be named by the major piece which occupies the end position. Because there is both a left file and a right file for each player, such a convention is not possible. For notation purposes, on a three-player game white's right files (equivalent to black's ranks may be designated by using lettering notation with "a" denoting the first right file to the left and "k" denoting the last or 11th right file to the far right of the board. For simplicity, mapping of particular positions of pieces may be referenced to only white's rank numbers and only white's right file letters for the coordinates with white's right file letter as the first coordinate and white's rank number as the second coordinate. Using this system and referring to FIG. 5, the location of king 54 would be at i4. Movement of king 54 to space 56 along white's "i" right file would be noted as: i4i5.

Movement and Capture of Pieces

As in the conventional two-player chess game, captures are always made by displacing the captured piece from the space which it occupies. No piece can capture or occupy a space already occupied by one of its own coloured pieces.

Figure 5:
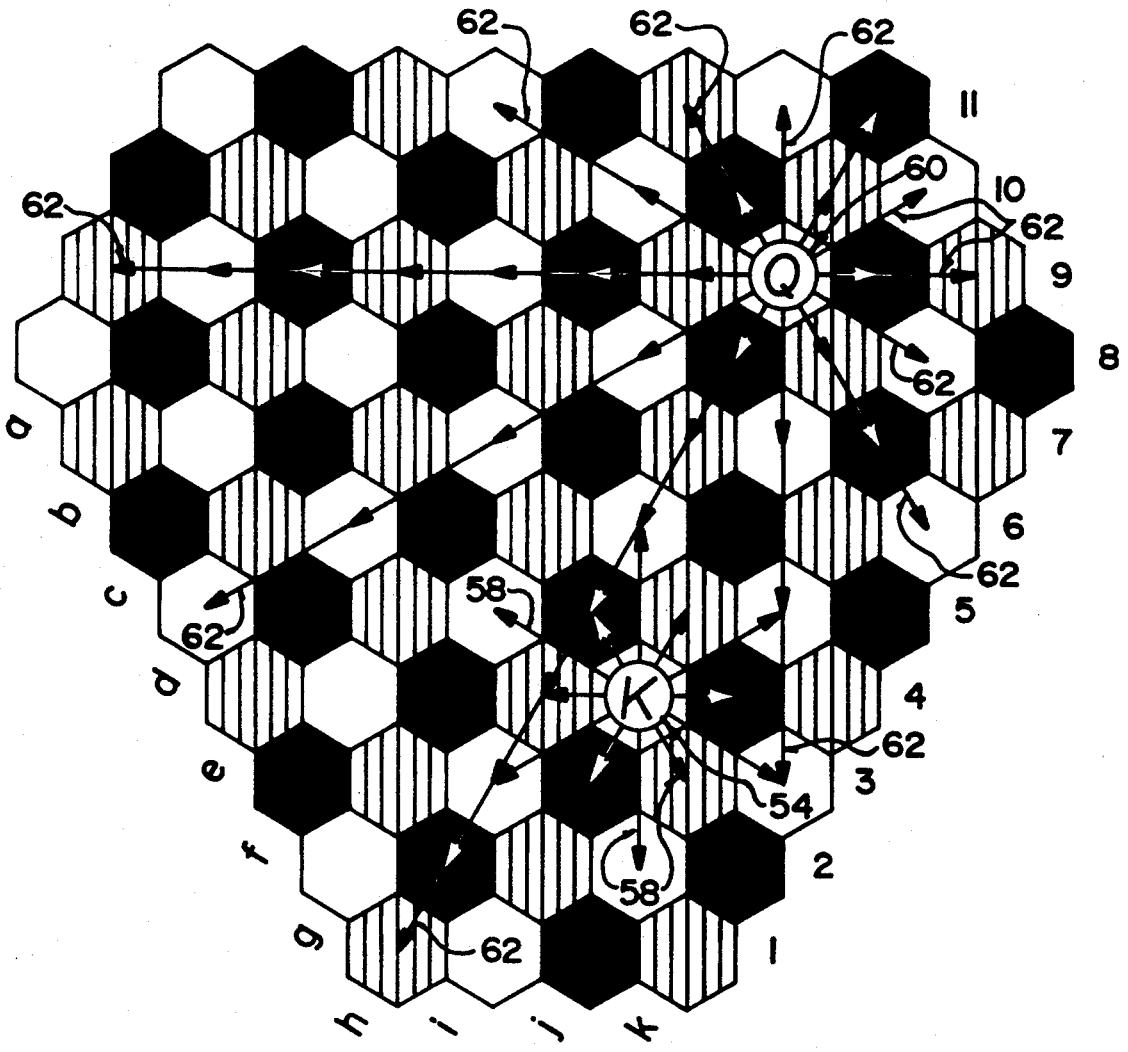
FIG. 5 is a plan view of the game board of FIG. 1 showing the possible moves of a king and the possible moves of a queen.

Referring to FIG. 5, the king 54 may move in any direction, to any adjacent space, one hexagon per move. The choice of moves is depicted in FIG. 5 by arrows 58. This includes a one-space move along a row of the same colour as that on which a king resides. As in the conventional chess game, the king can never move into "check" i.e. it cannot move to a hexagon commanded by an opponent's piece. Due to the hexagonal spaced board, the king's movement options have increased from eight to 12, as compared to the conventional two-person game.

Referring to FIG. 5 the queen 60 moves in any direction, in a straight line, and commands all the hexagons in these various directions, no matter what distance from the queen a particular opponent's piece is. The queen may move any number of spaces so long as no change in direction occurs and provided that the queen may not move over another piece. Arrows 62 depict possible movement of queen 66.

Figure 6:
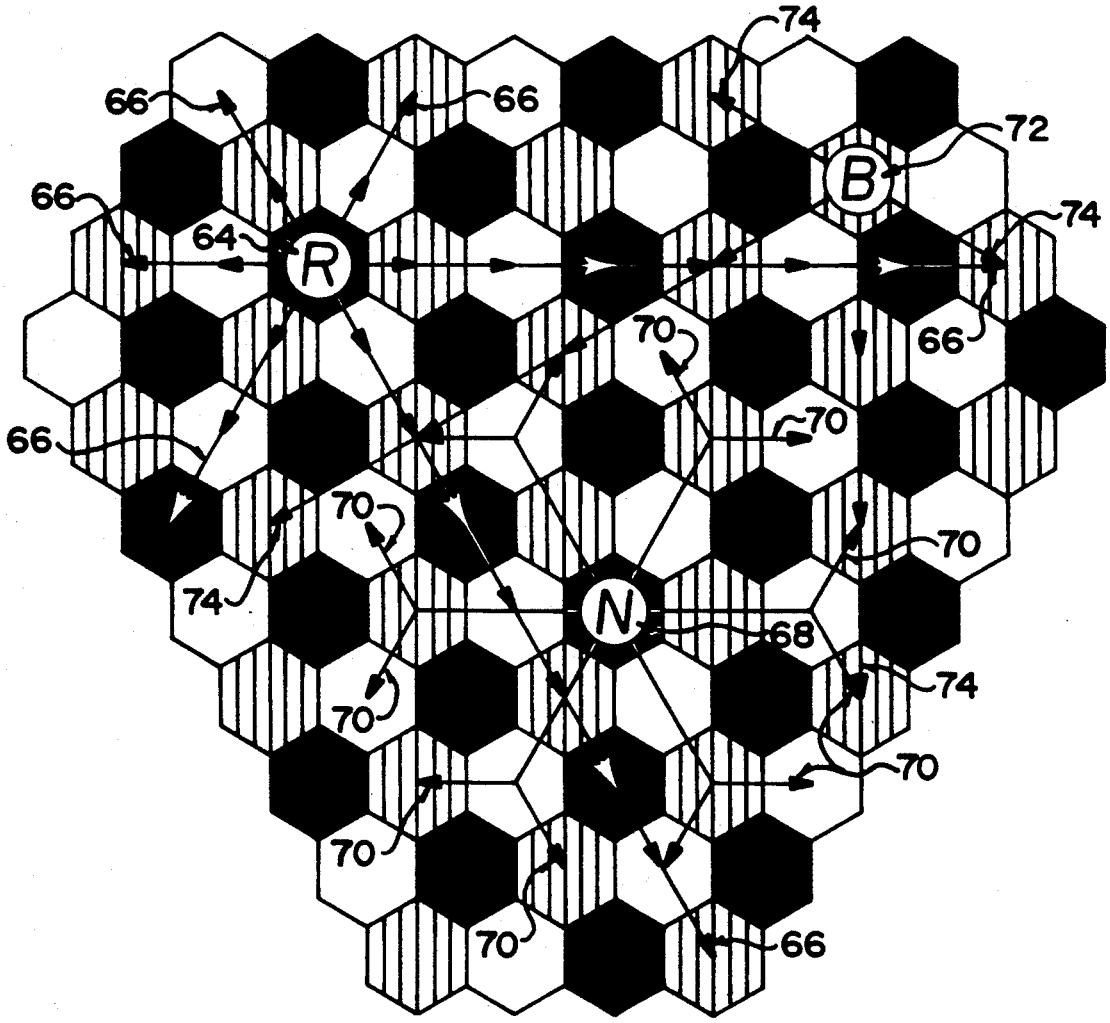
FIG. 6 is a plan view of the game board of FIG. 1 showing the possible moves of a rook, the possible moves of a knight and the possible moves of a bishop.

Referring to FIG. 6, rook 64 may move along any rank or file, in one direction per move and commands all hexagons in these several directions. Arrows 66 indicate potential movement of rook 64. It can be seen that rook 64 has six possible moves, as compared to the four possible moves of the rook in a conventional two-player chess game. Rook 64 may move any number of spaces, provided that it does not go over any other piece and provided that it travels in a straight line.

FIG. 6 also depicts the potential moves of knight 68 shown by arrows 70. The familiar L-shaped movement of the knight in a conventional chess game has been relatively preserved. The knight moves along the ranks or files three hexagons at a time but not in the same line. Knight 68 must either move two hexagons along any rank or file in a straight line and then change to a new rank or file for the third hexagon, or vice-versa, that is one hexagon forward, then two hexagons in a straight line along a new rank or file. The knight 68 can never move to a hexagon that is the same colour as the one it moves from. Knight 68 is the only piece that can leap over its own or opponent's pieces when these are located on the intermediate hexagons of its move. Knight 68 move options have increased from eight to 12, as compared to the conventional two-player chess game.

FIG. 6 also depicts bishop 72 with its potential moves depicted by arrows 74. Each bishop commands only its occupied colour, which colour remains unchanged throughout the course of the game. Consequently, each bishop supplements the other two, one moving only on the white hexagons, one moving only on the black hexagons and one moving only on the red hexagons. Bishop 72 may move only in one direction per move, any number of spaces, along spaces of the same colour only. Bishop 72 move options have increased from four to six, as compared to the conventional two-player chess game.

Figure 7:
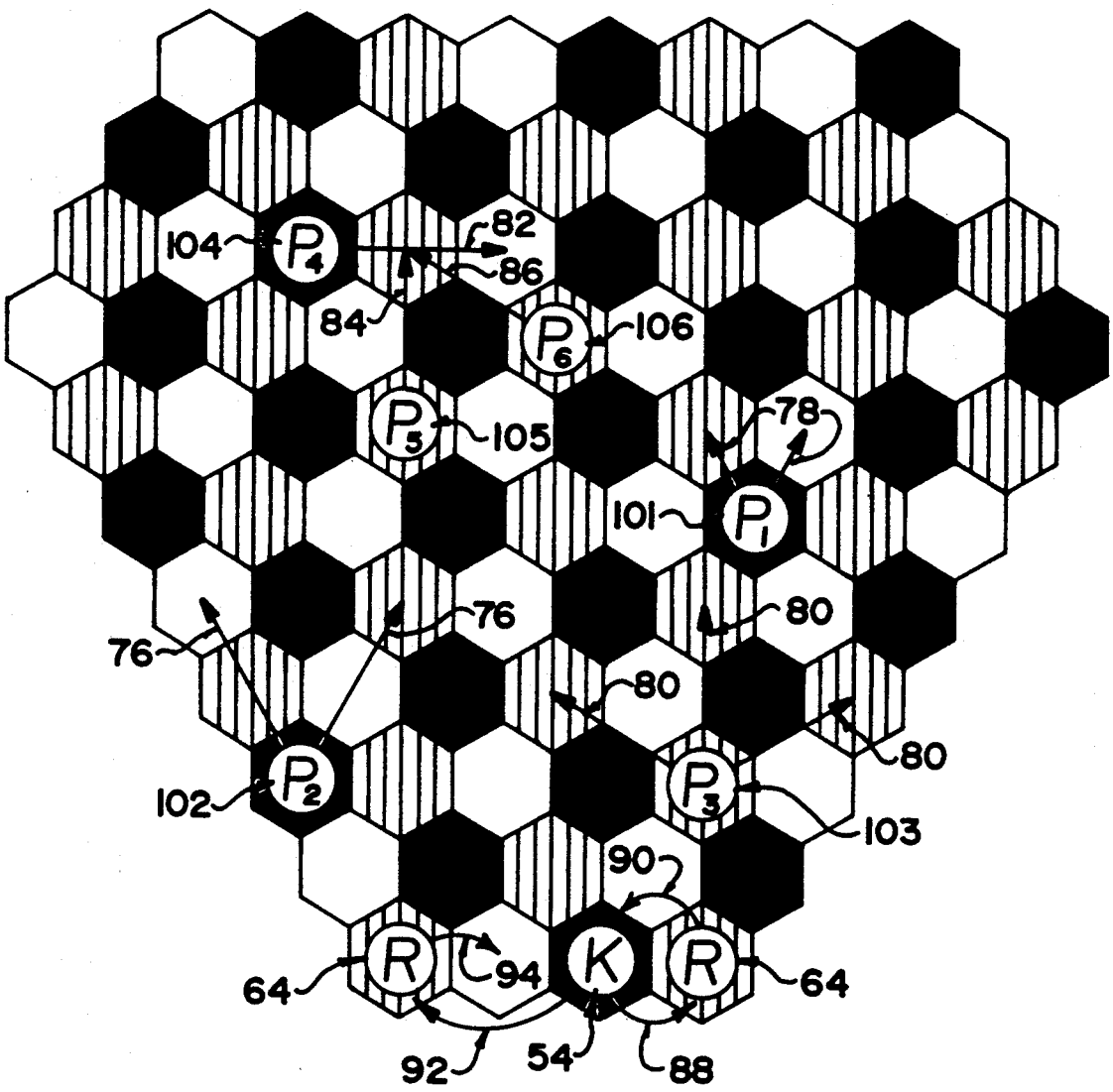
FIG. 7 is a plan view of the game board of FIG. 1 showing the possible moves of a pawn, including the regular movement of the first move option, the movement when capturing and capturing "en passant". Also shown in FIG. 7 is the "castling" move.

FIG. 7 depicts potential movement of pawns. As with the conventional chess game, each pawn has the option, as its initial move, to move either one or two spaces forward. Pawn $P_2$ 102 depicts initial optional movement of the pawn forward two spaces, as shown by arrows 76. Pawn $P_1$ 101 shows an intermediate move of pawn $P_1$ 101 one space at a time, as depicted by arrows 78. When not capturing, pawns $P_1$ 101 and $P_2$ 102 advance along either the left file or the right file forward only, one space per move, following the initial move which provides a one-move or two-move option as described above. If the two-move option is chosen, pawn $P_2$ 102 may not change directions for the second space. The possible moves of pawns $P_1$ 101 and $P_2$ 102 when not capturing is two, either along a left file or a right file. This is compared to one directional movement forward of pawns in the conventional two-player game.

FIG. 7 depicts movement of pawn $P_3$ 103 when capturing an opponent's piece. Pawn $P_3$ 103 may only capture in a forward direction and only along adjacent spaces of the same colour, in a forward direction, as depicted by arrows 80. When capturing, pawn $P_3$ 103 may move in one of three forward directions, as compared to two directions of pawns in the conventional game.

FIG. 7 depicts two examples of the "en passant" move as a capture option of a pawn. Capturing en passant in the three-player game is the same in principle as in the conventional two-player game. The move may occur when one player's pawn, exemplified in FIG. 7 by pawns $P_5$ 105 and $P_6$ 106, has advanced across the board until in appropriate proximity to another player's pawn, exemplified in FIG. 7 by pawn $P_4$ 104, which has not yet moved. If pawn $P_4$ 104 is moved the initial two spaces (thereby avoiding capture from pawns $P_5$ 105 or $P_6$ 106 had only one space been moved), the first player may still capture the other player's pawn as though that player had moved only one space by movement of the first player's pawn in the direction of arrows 84 or 86. In the example shown in FIG. 7, pawn $P_4$ 104 is moved in the direction of arrow 82. This type of capture can only be exercised immediately on a player's next turn after another player makes the initial two-space move.

As in the conventional two-player chess game, if a pawn is able to reach its highest rank without being captured, it immediately can and must be replaced by any piece desired except a king. As a rule, a queen is selected, thus allowing for the broadest range of movement and permitting two or more queens by one player. However, many chess players feel that the pawn's promotion options should be limited to only the pieces of that player that have been captured, effectively eliminating the possibility of acquiring more of one type of piece than in the initial setup of the game. So long as players agree at the outset of the game, either rule can be employed in the three-player chess game.

FIG. 7 also depicts the "castling" option. This is the only move option in which a player may move more than one piece at a time. The move is made only by king 54 and either rook 64. When the move is made with the king's rook, the rook adjacent the king, the move is called "castling king side" and is depicted by arrows 88 and 90. When the castling move is made with the queen's rook, it is called "castling queen side" as depicted by arrows 92 and 94. As in conventional chess, castling is only possible if all of the following prerequisites are met:

(a) neither the king or chosen rook must have been moved previously;

(b) castling cannot be played as a reply to an enemy attack (check) on a king;

(c) the king cannot move to or pass a space commanded by either opponent; and (d) all of the spaces between the king and chosen rook must be unoccupied. In the three-player chess game this is a much more readily achievable situation in that the knights and bishops no longer share the first rank between the king and the rooks and only the queen need by moved in order to castle queen side. Castling king side may occur at any time. In order to preserve the traditional aspect of the move, the prerequisite of unoccupied spaces extends to the appropriate knight and bishop as if it would be in the same rank as the king and rook being moved. In other words, a player cannot castle king side until the spaces of the king's bishop and king's knight are unoccupied and cannot castle queen side until the spaces of the queen, queen's bishop and queen's knight are unoccupied.

Provided the foregoing conditions have been met, to castle king side, the player simply switches the positions of the king and the king's rook as depicted in FIG. 7 by arrows and 90. To castle queen side, the king and the queen's rook are interchanged as depicted in FIG. 7 by arrows 92 and 94.

Because the three-player chess game is played with three players, some modification of the rules relating to check and checkmate are necessary. Much of these modifications are required due to intervening actions which may occur by the third player not immediately involved with the check. As a consequence, unlike the two-player game, a player may have the check removed from his king by the actions of the third player in either interposing a piece between the attacking piece and the checked king, or capturing the attacking piece or by placing the attacking player's king in check thereby forcing the attacking player to defend his own king rather than checkmating the king he or she is attacking. In the last case, the player under attack may ignore check on his king for at least one move, but he would remain in check once the attacking player had removed the check on his or her own king.

Checkmate occurs when a king is placed in check and cannot get out of check on that player's next move. Again, the tree-player game provides added possibilities, as the intervening action of the third player can effect a check which might otherwise be a checkmate by "saving" the king from the checkmate. In essence, the third player's intervening moves can dramatically effect a given move, whether it be a checkmate, a check, a capture or any move, threatening or not. In effect, the intermediate player can augment or diminish a move of a first player before a third player can react to it. Because of this intervening move and the possibility of removing a checkmate, an initial checkmate situation is referred to as a "pending" check or mate.

For example, the third uninvolved player may wish to void a particular check or mate and may accomplish this by several means if in a position to do so. That player could capture the checking piece himself (or any other piece relevant to the mate) or interpose his own piece to block the check. As well, if the attacking player constituted the check or mate by relying on one or more of the uninvolved player's pieces, the uninvolved player could move a piece out of the mate situation, thus allowing the attacked player's king to escape.

The reverse of this situation is also possible. The uninvolved player may actually create a checkmate out of a check created by an attacking player. The checkmate can be created by the uninvolved player moving a piece to where it now commands a space or spaces that the checked king might otherwise escape to.

A player may also constitute a check, checkmate or pending check or mate without actually having a checking piece attacking the king. This occurs where a player has a piece interposed between one opponent's king and the other opponent's piece which would otherwise put that king in check or mate. That player moves his interposed blocking piece from between the checking piece and the king, thus constituting check or mate, which may or may not be pending, even though that player does not have the actual checking piece.

As another possibility, in some situations a pending checkmate may not only be voided, but simultaneously a new checkmate against the same attacked king may be substituted in its place by the other player.

As a unique added element to increase the enjoyment of the three-player game, and to provide some reward (and incentive) to the player who achieves the first checkmate and thereby eliminates the first player, the player who constitutes the first checkmate receives a special bonus. As that player's next turn, he has the option of replacing any one of his own pieces, or any one of the checkmated player's remaining pieces on the board (except the king) with any of his own captured pieces.

This potential bonus to an attacking player can be taken from that player by the player uninvolved in the check if that player not only removes the pending checkmate but substitutes a checkmate of his own. If an attacking player simply creates a check and not a pending mate and the second player creates a mate, whether he uses that check to do so or not, the second player receives that bonus option due to his or her creating the mate, regardless of whether or not the second player blocks the first player's check, as it is the second player which creates the mate. As well, an actual pending mate cannot be taken by merely adding an additional check or by merely moving a participating piece to a different participating location. However, in the case where the second player's piece is used by a first player to do the actual checking as constituted by the first player's move as described above, the second player could take that bonus away by moving that piece to a different checkmating location that is not along the same line of attack. Otherwise, to legitimately take the bonus, the second player must either block his own piece by interposing a new checking piece, or in a rare situation, if the checking piece was already interposed between yet another otherwise checking piece, whether that player's own or not, the player could move the first constituted checking piece from between that piece and the king. Any of the described moves would effectively eliminate the first player's constituted check, and thus if checkmate was maintained, the second player would receive the bonus option rather than the first attacking player.

When a first player is checkmated, his remaining pieces, including his king, remain on the board. These dormant pieces now cannot move, so the remaining two players need not fear attack from the checkmated player's pieces, and any player may capture those pieces, except for the king, and move freely between them as need be. However, these dormant pieces are not entirely without power in that both remaining opponents' kings still cannot move into check from them. In other words, each player's kings cannot move to any spaces that a dormant piece would normally command.

A game is drawn when any of the following conditions apply:

(a) a draw by agreement;

(b) a player is able to check at will but cannot achieve a decisive result (maximum of 50 moves without capture of a piece or movement of a pawn);

(c) the position is repeated three times, with the same player moving the same way each time (typically a chase situation); and (d) one of the players is stalemated. The game is drawn for all players on a stalemate. This occurs when a king is not in check and is forced to move but cannot do so without moving into check.

As an additional option, to ensure that the turn of the game moves in a clockwise direction, which is generally preferred, in order to maintain the players in turn order of white first, then black and then red, the spaces are arranged in the same order, that being white, black and red from left to right horizontally, from any player's perspective. This arrangement of spaces is shown in FIG. 1. Alternatively, if play in a counter-clockwise direction is desired, the spaces can be reversed accordingly so that the turn order of white first, then black and then red can be exemplified by the spaces arranged in proper order for counter-clockwise play.

Figure 8:
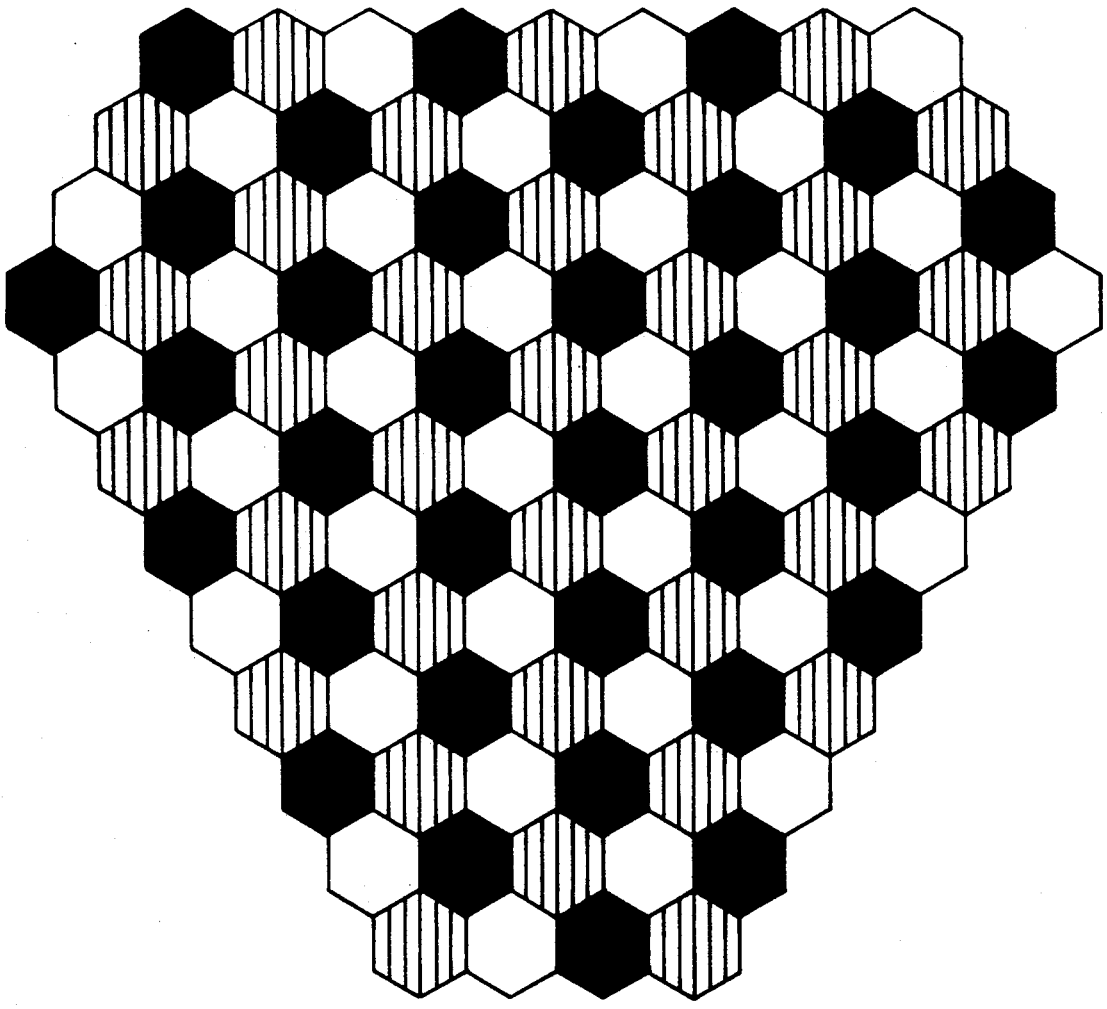
FIG. 8 is a plan view of an alternate game board of the invention, in which nine spaces along each side are provided.
Figure 1:
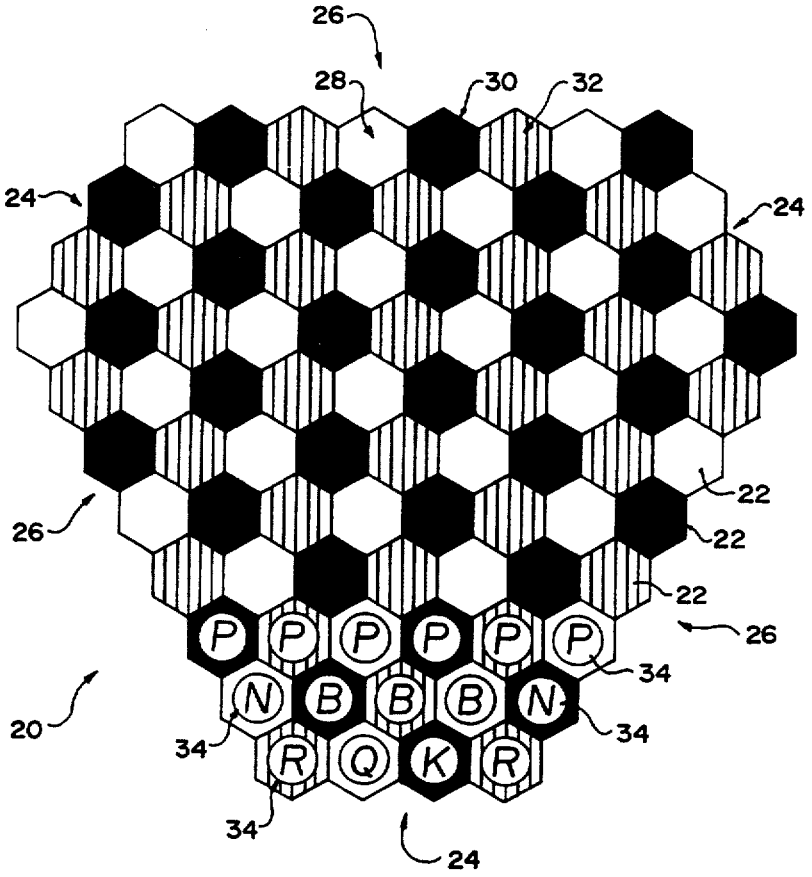
Figure 5:
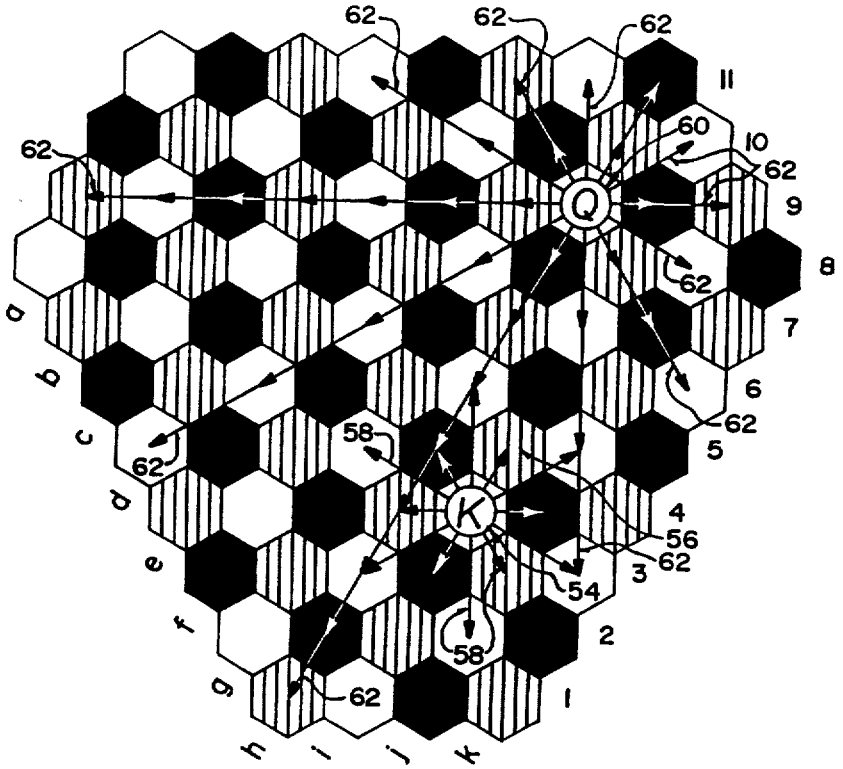

Referring to FIG. 8, an alternate embodiment of the three-play chess game board is shown in which the board still has four spaces at the apexes but nine spaces along each side, thereby adding one rank and one file to the game board. In this embodiment the occupied to unoccupied ratio is 45/102 or 44.12 percent. The alternate game board provides an increased distance between opponents at opening and may be desired by some players. The play on either embodiment is essentially a matter of personal preference, as all rules of play are the same for the alternate embodiment board shown in FIG. 8 as compared to the board shown in FIG. 1.

I claim:

1. A game apparatus, comprising:

(a) a game board, comprising:

i. a plurality of contiguous hexagonal playing spaces uniformly distributed on the board;

ii. said spaces forming a truncated triangular periphery having three longer sides and three shorter apexes;

iii. each of said apexes comprising no more than four of said spaces;

iv. each of said spaces including one of three space indicia such that no two adjacent spaces have the same space indicia;

(b) a set of playing pieces for each of two or three players;

(c) each of said set of playing pieces being initially disposed on spaces in the first three ranks adjacent each respective apex.

2. An apparatus as described in claim 1, wherein each of said sides limited to eight of said spaces.

3. An apparatus as described in claim 2, wherein the number of playing pieces in each set is limited to fifteen.

4. An apparatus as described in claim 3, wherein said pieces are chess playing pieces with one queen, one king, two rooks, two knights, three bishops and six pawns.

5. An apparatus as described in claim 4, wherein said queen, king and two rooks are positioned in the first rank of one of said apexes for pieces of the same indicia, two knights and three bishops are positioned in the second rank adjacent said first rank and said six pawns are positioned in the third rank.

6. An apparatus as described in claim 5, wherein said three bishops are adjacent one another and said two knights flank the said bishops at each end of said second rank.

7. An apparatus as described in claim 4, wherein said queen is positioned to the left of said king and said rooks flank said king and queen on each outer space of said first row.

8. An apparatus as described in claim 4, wherein said king is positioned to the left of said queen and wherein said rooks flank said king and queen on each outside space of said first row.

9. An apparatus as described in claim 1, wherein each of said sides limited to nine of said spaces.

10. An apparatus as described in claim 1, wherein said pieces move substantially in the same manner as pieces in a conventional chess game.

11. An apparatus as described in claim 1, wherein each set of playing pieces comprises piece indicia corresponding to one of said three space indicia.

12. An apparatus as described in claim 11, wherein the piece indicia and corresponding space indicia are visually distinguishable colours.

13. An apparatus as described in claim 12, wherein the piece indicia and space indicia colours are black, white and red.

14. An apparatus as described in claim 1, wherein said space indicia are oriented in the order of each player's turn.

15. A game apparatus comprising a gameboard comprising a plurality of contiguous hexagonal playing spaces uniformly distributed on the board; said spaces forming a truncated triangular periphery having three longer sides and three shorter apexes; each of said apexes limited to four of said spaces and each of said spaces including one of three space indicia such that no two adjacent spaces have the same space indicia; a set of playing pieces for each of two or three players; each of said set of playing pieces being initially disposed on spaces in the first three ranks adjacent each respective apex; wherein said pieces include three bishops disposed in the second rank of each respective apex adjacent one another in the middle three spaces of the second rank.

16. An apparatus as described in claim 1, wherein each of said apexes has exactly four spaces.

* * * * *

UNITED STATES PATENT AND TRADEMARK OFFICE

CERTIFICATE OF CORRECTION

PATENT NO. : 5,158,302

DATED : October 27, 1992

INVENTOR(S) : Dana Richard Rewega

It is certified that error appears in the above-identified patent and that said Letters Patent is hereby corrected as shown below:

The title page, should be deleted to be replaced with the the attached page.

The drawing sheets, consisting of Fig. 1 and Fig. 5, should be deleted to be replaced with the drawings sheets, consisting of Fig. 1 and Fig. 5, as shown on the attached pages.

Signed and Sealed this

Thirtieth Day of November, 1993

*Attest:*

*Attesting Officer*

BRUCE LEHMAN

*Commissioner of Patents and Trademarks*

United States Patent [19]

Rewega

[11] Patent Number: 5,158,302

[45] Date of Patent: Oct. 27, 1992

[54] THREE-PLAYER CHESS GAME

[76] Inventor: Dana R. Rewega, 201 - 146 E. 18th Street, North Vancouver, British Columbia, Canada, V7L 2X5

[21] Appl. No.: 764,516

[22] Filed: Sep. 20, 1991

[51] Int. Cl.[5] ..... A63F 3/02

[52] U.S. Cl. ..... 273/261; D21/24

[58] Field of Search ..... 273/261, 260; D21/24

[56] References Cited

U.S. PATENT DOCUMENTS

| | | | |
|---|---|---|---|
| 259,695 | 6/1882 | Kingwell | 273/261 |
| 3,533,627 | 10/1970 | Deffenbaugh et al. | 273/261 |
| 3,744,797 | 7/1973 | Hopkins | 273/261 |
| 3,778,065 | 12/1973 | Hale | 273/261 |
| 3,836,149 | 9/1974 | Adams et al. | 273/261 |
| 3,964,747 | 6/1976 | Balmforth | 273/261 |
| 4,580,787 | 4/1986 | Baker | 273/261 |

FOREIGN PATENT DOCUMENTS

| | | | |
|---|---|---|---|
| 2225729 | 6/1990 | United Kingdom | 273/261 |

OTHER PUBLICATIONS

"Rules of the Game of Hex" by Andrew S. Braden, pp. 20–21, 1970.

*Primary Examiner*—Benjamin H. Layno

*Attorney, Agent, or Firm*—Bull, Housser & Tupper

[57] ABSTRACT

A chess game for three players including a game board of generally truncated triangular shape with 4 spaces at the apex and 8 or 9 spaces along each side. Hexagonal shaped spaces of three alternating colors are located uniformly on the surface of the board. The game includes 3 sets of chest pieces with 6 pawns, 3 bishops, 2 knights, 2 rooks and queen and a king in each set. On opening, each set of playing pieces is located in the first 3 rows of the apexes on the board.

16 Claims, 8 Drawing Sheets

1/8

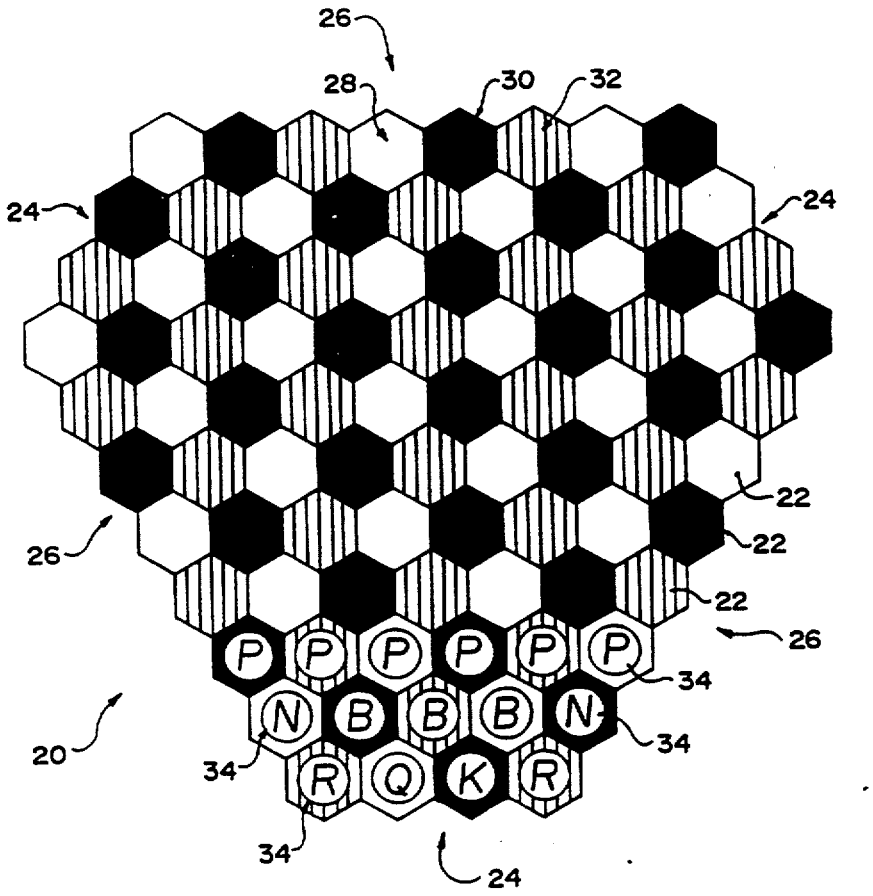

1/8

5/8